US005224278A

United States Patent [19]

Jeon

[11] Patent Number: 5,224,278

[45] Date of Patent: Jul. 6, 1993

[54] MIDSOLE HAVING A SHOCK ABSORBING AIR BAG

[76] Inventor: Pil D. Jeon, 1395, Daeyeon 5 dong, Namgu, Busan, Rep. of Korea

[21] Appl. No.: 946,726

[22] Filed: Sep. 18, 1992

[51] Int. Cl.[5] ..... A43B 13/20

[52] U.S. Cl. ..... 36/29; 36/27; 36/35 B; 36/38

[58] Field of Search ..... 36/27, 28, 29, 35 R, 36/35 B, 37, 38, 92, 3 B, 7.8

[56] References Cited

U.S. PATENT DOCUMENTS

| | | | |
|---|---|---|---|
| 733,167 | 7/1903 | Denton | 36/37 |
| 1,098,241 | 5/1914 | Forray | 36/38 |
| 1,099,180 | 6/1914 | Karacsonyi | 36/38 |
| 1,338,817 | 5/1920 | DeLuca | 36/38 |
| 4,521,979 | 6/1985 | Blaser | 36/29 |
| 4,610,099 | 9/1986 | Signori | 36/3 B |
| 4,680,875 | 7/1987 | Danieli | 36/28 |
| 4,715,130 | 12/1987 | Scatena | 36/28 |

*Primary Examiner*—Steven N. Meyers
*Assistant Examiner*—Thomas P. Hilliard
*Attorney, Agent, or Firm*—Lowe, Price, LeBlanc & Becker

[57] ABSTRACT

A midsole having a bellows type of shock absorbing air bag and a method for preparation of such a midsole. The present midsole comprises a hexahedral-shaped air bag for absorbing an outer shock and comprising upper and lower parts which are provided with a plurality of vertical bellows members, a plurality of elastic bodies for providing elasticity for the air bag and being received in each bellow member, a plurality of upper and lower caps for causing the elastic bodies to maintain their positions in the bellows members and being mounted on the air bag as engaging with an open end of each bellows member, an air control valve for controlling air charge in or air discharge from the air bag and an air communication pipe for permitting the air bag to communicate with the air control valve by being connected at an end thereof to the air bag and at the other end to the air control valve. The present invention provides a midsole which freely controls its cushioning in accordance with the using object of the shoe and is provided with a shock absorbing air bag having an excellent resilience.

9 Claims, 4 Drawing Sheets

MIDSOLE HAVING A SHOCK ABSORBING AIR BAG

BACKGROUND OF THE INVENTION

1. Field of the Invention

The present invention relates in general to a midsole of a shoe having a shock absorber or a cushion and a method for preparing such a midsole, and more particularly to a midsole having a bellows type of air bag as the shock absorber and a method for preparation of such a midsole.

2. Description of the Prior Art

A known shoe such as a sports shoe is generally provided at its outer sole with a resilient midsole which is to absorb the pressure, said pressure intending to be transferred from the ground to the sole of wearer's foot when the wearer takes a step forwards in the course of walking or running, in this respect, to prevent the wearer's foot from suffering from the pressure and to provide the comfort of the wearer. In order to provide such a resilient midsole for the shoe, the outer sole of the shoe is conventionally provided with a sponge midsole, a combined foam midsole and a midsole enclosing a closed bag-shaped air bag.

However, it is noted that the known shoe having aforementioned midsole, that is, the sponge midsole, the combined foam midsole and the midsole enclosing the closed bag-shaped air bag, has a disadvantage in that the cushioning of the midsole can not be freely controlled in order to correspond to the using object of the shoe and the resilience of the midsole is relatively lower than it is conventionally required.

The above disadvantage of the shoe having the known midsole is necessarily caused by uniformly manufacturing the midsole and equipping the shoe with this midsole regardless of the conditions in practically using the shoe such as using object of the shoe, the wearer's weight and the like. In other words, while the resilient midsole manufactured by the aforementioned process provides somewhat shock absorbing effect for the shoe, it also introduces several problems. For example, the air bag, having a bag-shaped outer appearance as it is prepared by a conventional preparation method wherein the previously cut raw materials are simply welded to each other using a high-frequency resistance welder, necessarily has a substantially larger welding area than it is needed to improve the cushioning effect of the midsole. In addition, if this type of air bag is charged with air, its swollen shape shows an inclined bag-shaped outer appearance and, in this respect, its volume is necessarily reduced and this causes the shock absorbing effect of the air bag to be deteriorated. Furthermore, in consideration of the known manufacturing process wherein the air bag is uniformly manufactured and equipped to the shoe regardless of the conditions such as using object of the shoe, the wearer's weight and the like, the practical shock absorbing effect of the air bag is deteriorated.

SUMMARY OF THE INVENTION

It is, therefore, an object of the present invention to provide a midsole in which the above-mentioned disadvantage can be overcome and which freely controls its cushioning in accordance with the using object of the shoe and is provided with a shock absorbing air bag having an excellent resilience. The present invention also includes a method for preparation of such a midsole.

In an aspect, the present invention provides a midsole having a shock absorber comprising: a hexahedral-shaped air bag for absorbing an outer shock, said air bag comprising upper and lower parts which are provided with a plurality of vertical bellows members; a plurality of elastic bodies for providing elasticity for said air bag, each said elastic body being received in each bellow member; a plurality of upper and lower caps for causing said elastic bodies to maintain their positions in the bellows members, each said cap being mounted on the air bag as engaging with an open end of each bellows member; an air control valve for controlling air charge in or air discharge from the air bag; and an air communication pipe for permitting the air bag to communicate with said air control valve, said air communication pipe being connected at an end thereof to the air bag and at the other end to the air control valve.

In another aspect, the present invention provides a method for preparation of a midsole having a shock absorbing air bag comprising the steps of: injection molding an upper part and a lower part, both constituting said air bag and respectively having a plurality of bellows members which are opposite to each other; welding each two opposite bellows members to each other with a center ball interposed therebetween; welding the peripheries of said upper and lower parts of the air bag to each other; enclosing a spring in each said bellows member and covering an open end of the bellows member with a cap, thereby closing said open end of the bellows member; and making said air bag communicate with an air control valve by connecting an air communication pipe therebetween.

BRIEF DESCRIPTION OF THE DRAWINGS

The above and other objects, features and other advantages of the present invention will be more clearly understood from the following detailed description taken in conjunction with the accompanying drawings, in which:

FIGS. 6*a* and 6*b* are views corresponding to FIG. 5, but showing alternate embodiments of a shock absorbing air bag having a cylindrical bellows member, in which:

FIG. 6*a* shows a second alternate embodiment having a compression coil spring as the shock absorber; and FIG. 6*b* shows a third alternate embodiment having an elastic rubber as the shock absorber.

DETAILED DESCRIPTION OF THE PREFERRED EMBODIMENTS

Figure 1:
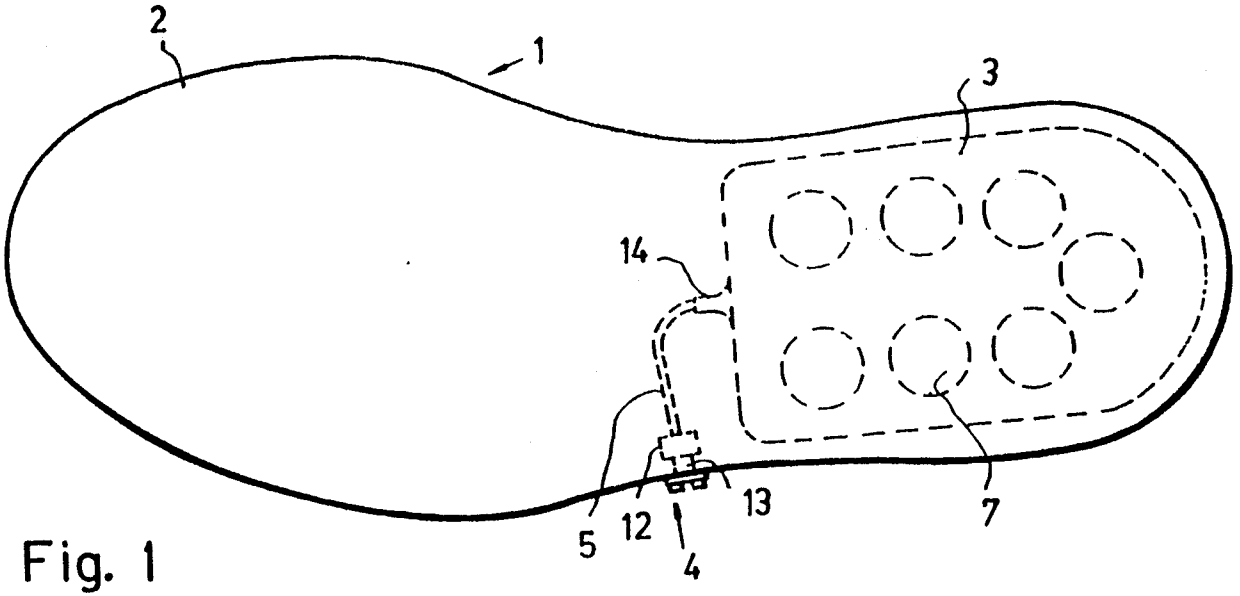
FIG. 1 is a plane view showing an embodiment of a midsole having a first alternate embodiment of a shock absorbing air bag in accordance with the present invention.
Figure 2:
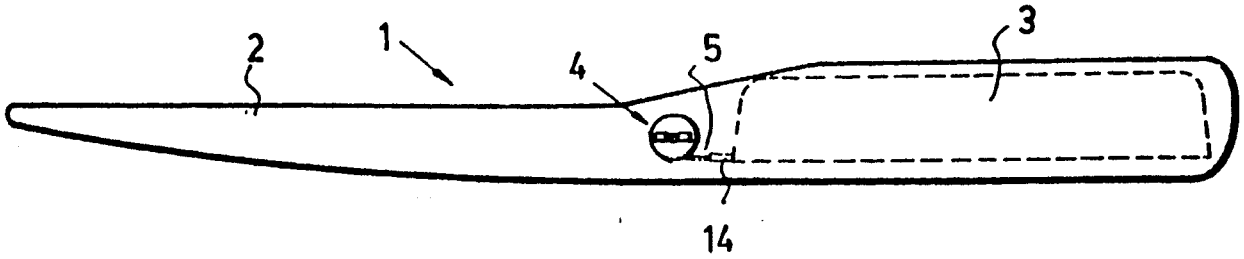
FIG. 2 is a side view of the midsole of FIG. 1.

With reference to FIGS. 1 and 2 respectively showing an embodiment of a left-side midsole 1 having a first embodiment 3 of a shock absorbing air bag in accordance with the present invention, this midsole 1 comprises a main body 2, preferably made of conventional polyurethane. This main body 2 encloses a shock absorbing air bag 3 in its rear part which is generally known as a part to which most of the outer shock or the pressure is applied. At a middle side of the main body 2, an air control valve 4 is mounted so as to communicate with the air bag 3 through an air communication pipe 5. This air control valve 4 is controlled in its opening state in order to control air discharging from the air bag 3.

Figure 3:
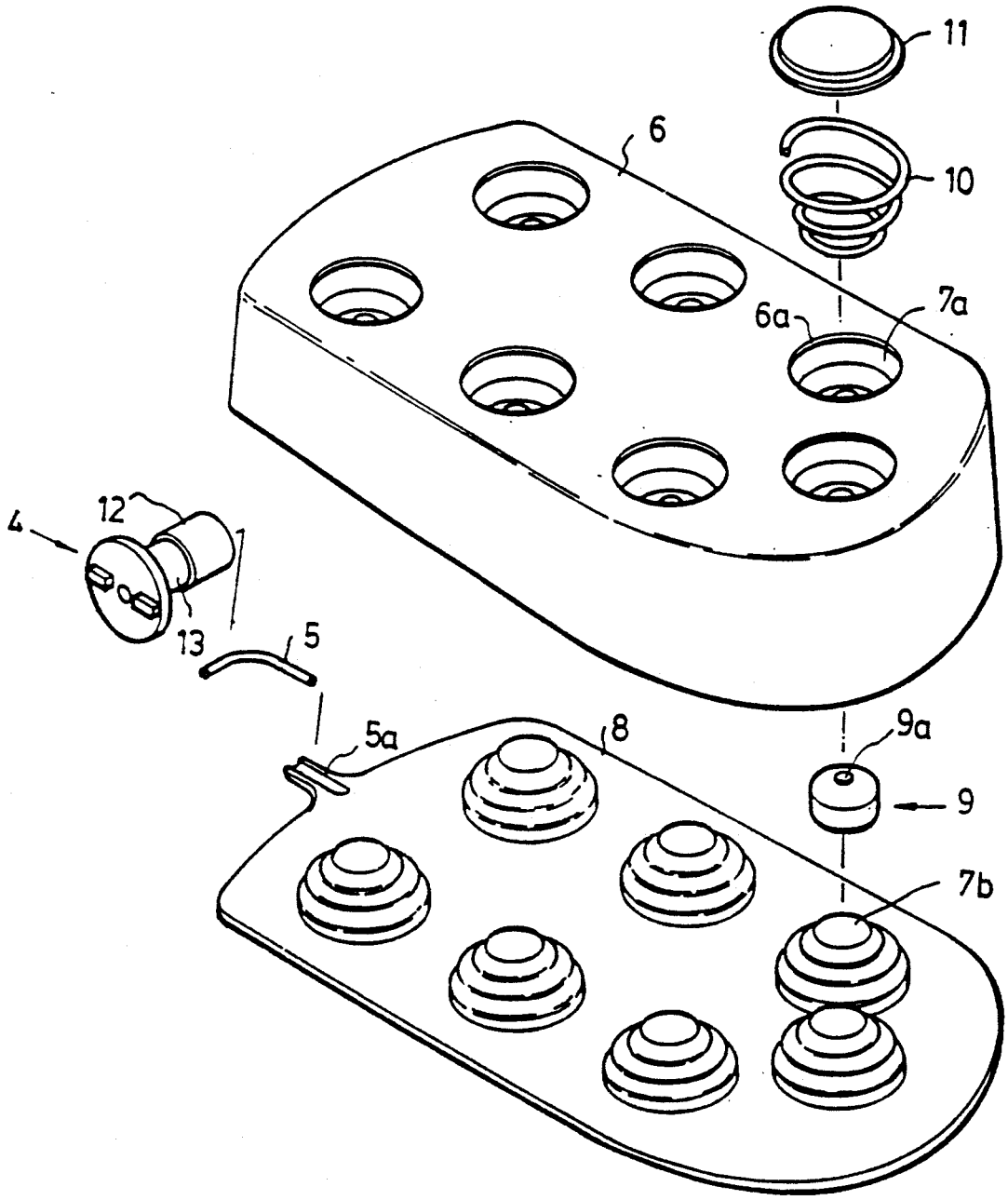
FIG. 3 is an exploded perspective view of the first alternate embodiment of the shock absorbing air bag of FIG. 1.

As depicted in FIG. 3, the air bag 3 has a nearly hexahedral outer appearance and, in this respect, it has a substantially larger volume than that of the known embodiment. This air bag 3 is provided with the air control valve 4 as described above so that it can be controlled in its air discharge characteristics within a large range, preferably in three types. The air bag 3 comprises an upper part 6 which has a nearly hexahedral box shape in order to determine the outer appearance of the air bag 3 and opens downwardly. This upper part 6 is also provided with bellows means comprising the effective number of reversed frusto-conical bellows protrusions 7*a* each of which integrally downwardly formed with the upper part 6 so as to open upwards. In this first alternate embodiment, seven frusto-conical bellows protrusions 7*a* are disposed along the periphery of the upper part 6 with predetermined appropriate intervals, however, the number of the protrusions 7*a* may be changed without departing from the scope of this invention. In addition, the protrusion 7*a* may be constructed to have another shape, for example, a cylindrical shape as will be described bellow in conjunction with FIGS. 6A and 6B. At a middle portion of an end of the upper part 6, this part 6 is also integrally provided with a semiannular-sectioned boss (not shown) constituting an air inlet boss 14, in cooperation with a counterpart 5*a* of a lower part 8 which will be in detail described bellow. This air inlet boss 14 receives an end of the air communication pipe 5. The upper part 6 is preferably formed by a conventional pinpoint gate injection molding process.

In order to complete the air bag 3, there is also provided the lower part 8 which is formed by the same manner, that is, the pin-point gate injection molding process, as that of the upper part 6. On this lower part 8, the effective number of frusto-conical bellows protrusions 7*b* are provided as upwardly protruding so as to correspond to those of the upper part 6. These protrusions 7*b* of the lower part 8 open downwards. Of course, these protrusions 7*b* may be constructed to have another shape, for example, the cylindrical shape as described in the upper part 6. At a middle portion of an end of the lower part 8, this part 8 is integrally provided with the semiannular-sectioned boss 5*a* constituting the air inlet boss 14 in cooperation with the aforementioned counterpart of the upper part 6.

In each frusto-conical bellows protrusion 7*a* or 7*b* of the upper or lower parts 6 or 8, a frusto-conical compression coil spring 10 is received so as to provide desired resilience for the air bag 3 and to permit the air bag 3 to reliably maintain its outer shape. In another embodiment of this invention, another type of elastic material such as an elastic rubber may be used instead of the coil spring 10 without departing from the scope of this invention. Such an elastic material, preferably made of an elastic rubber, will be referred to a third alternate embodiment shown in FIG. 6*b* even though this alternate embodiment has a cylindrical shape in order to correspond to the cylindrical bellows 15.

In order to permit the compression coil spring 10 to maintain its position in the bellows protrusion 7*a* or 7*b* without escaping therefrom, a spring cap 11 is provided as covering the open end of each bellows protrusion 7*a* or 7*b*. The open end of the bellows protrusion 7*a* or 7*b* is provided with an annular stop 6*a* or 8*a* for engaging with the circular periphery of the spring cap 11, thereby permitting the spring cap 11 to maintain its position irrespective of the outward biasing force of the coil spring 10 and the outer pressure. In order to make this spring cap 10 engage with the annular stop 6*a* or 8*a*, the spring cap 10 is inwardly forced until it is snapped down with respect to the annular stop 6*a* or 8*a*.

On the other hand, when the upper and lower part 6 and 8 are combined into the air bag 3 as will be in detail described bellow, each two corresponding frusto-conical bellows protrusions 7*a* and 7*b* of the upper and lower parts 6 and 8 are welded to each other with a center ball 9 interposed therebetween. Here, upper and lower surfaces of this center ball 9 are respectively provided with a center depression 9*a* which engages with a hemispherical projection 7*c* of the bellows protrusion 7*a* or 7*b*. In this respect, this center ball 9 does not move with respect to the bellows protrusions 7*a* and 7*b*. This center ball 9 has a role for collecting the pressure applied to the air bag 3 and vertically transferring this pressure to the upper or lower part 6 or 8. Therefore, even in the case of the pressure which is irregularly applied to the air bag 3 in irregular direction, the center ball 9 reliably collects the pressure and vertically transfers the pressure to the upper or lower part 6 or 8. In this respect, it is possible to efficiently prevent the shoe and/or the midsole 1 from being warped by the irregular pressure.

As shown in FIG. 3, the air control valve 4, mounted on the middle side of the main body 2 so as to control the air discharge from the air bag 3, comprises a female part 12 and a male part 13. The female part 12 is disposed in the middle side part of the main body 2 and the air communication pipe 5 is connected between the female part 12 and the air inlet boss 14, the latter comprising the semiannular bosses 5*a* of both the upper and lower parts 6 and 8, thereby permitting the two members 12 and 14 to communicate with each other. The outer threaded part of the male part 13 engages with the inner threaded part of the female part 12 and protrudes its outer end out of the side surface of the main body 2, as shown in FIG. 1, so as to permit the wearer to control the control valve 4. This male part 13 controls a variable air inlet port (not shown) of the air communication pipe 5. In addition, the female part 12 is provided with a rubber packing (not shown) for preventing the air leakage. This female part 12 also has at least one longitudinal groove (not shown) which is formed as crossing the threads of the inner threaded part of the female part 12 so that the air is charged in or discharged from the air bag 3 through this longitudinal groove when the male part 13 is loosened.

Figure 4:
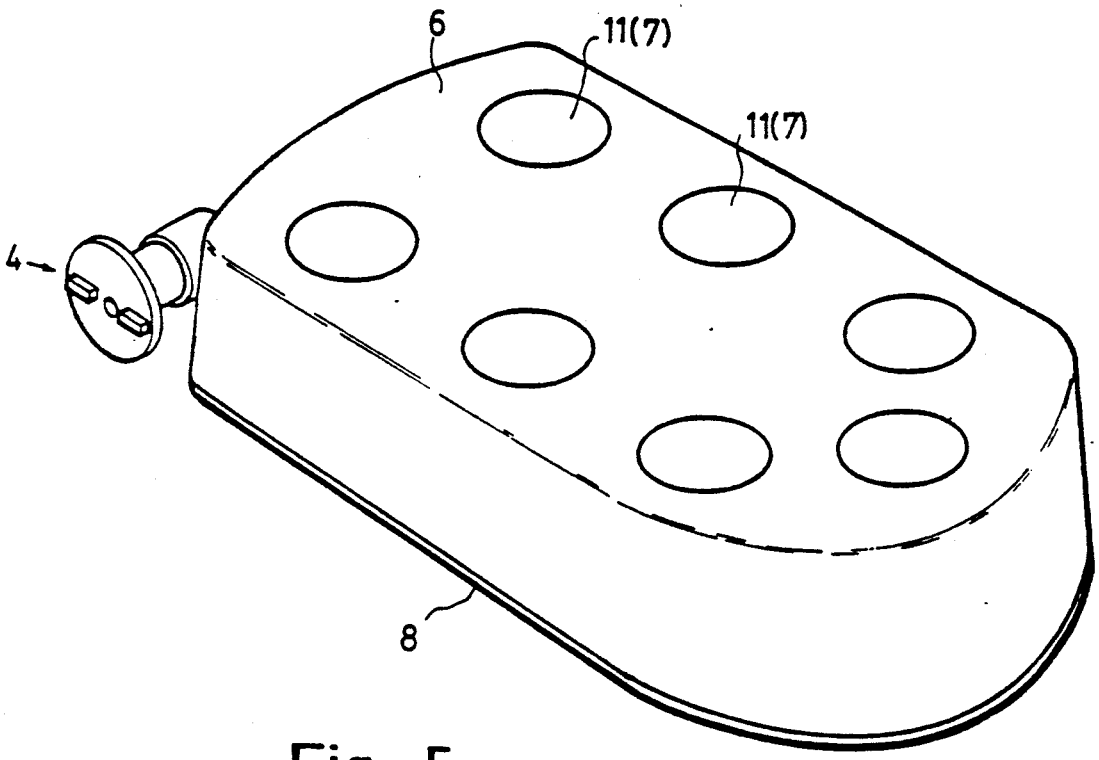
FIG. 4 is a perspective view of the assembled shock absorbing air bag of FIG. 3.

Turning to FIG. 4 showing the assembled air bag 3, the upper and lower parts 6 and 8, both previously prepared by the pin-point gate injection molding process, are combined into the air bag 3. In order to combine the upper and lower parts 6 and 8 into the air bag 3, the bellows protrusions 7*a* and 7*b*, receiving no coil spring 10 therein, of the parts 6 and 8 are welded to each other by the conventional high-frequency resistance welding process under the condition that each center ball 9 is interposed between the opposite protrusions 7*a* and 7*b*. In this case, the peripheries of the parts 6 and 8 are welded to each other by the same welding process. Thereafter, each coil spring 10 is received in the corresponding protrusion 7*a* or 7*b* and the spring cap 11 engages with the annular stop 6*a* or 8*a* so as to permit the spring 10 to maintain its position in the protrusion 7*a* or 7*b*. The assembled air bag 3 is then connected to the female part 12 of the air control valve 4 by connecting its air inlet boss 14 to the female part 12 through the air communication pipe 5. Thereafter, the main body 2 is formed by a conventional molding process as enclosing therein the air bag 3 along with the female part 12 of the valve 4 connected to the air bag 3 through the pipe 5. In this case, it is required to permit the formed main body 2 to have an opening for receiving the male part 13 of the control valve 4. After accomplishing the molding process of the main body 2, the male part 13 additionally engages with the female part 12.

Figure 5:
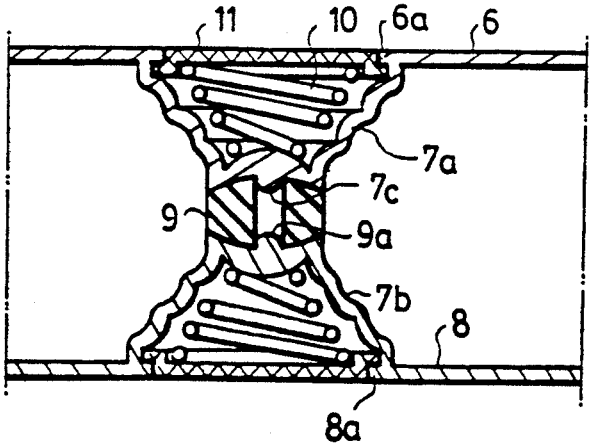
FIG. 5 is a partially enlarged sectioned view taken along the section line A—A of FIG. 4.

FIG. 5, a partially enlarged sectioned view taken along the section line A—A of FIG. 4, shows the frusto-conical compression coil springs 10 and the spring caps 11 which are positioned in their places in the air bag 3.

Figure 6A:
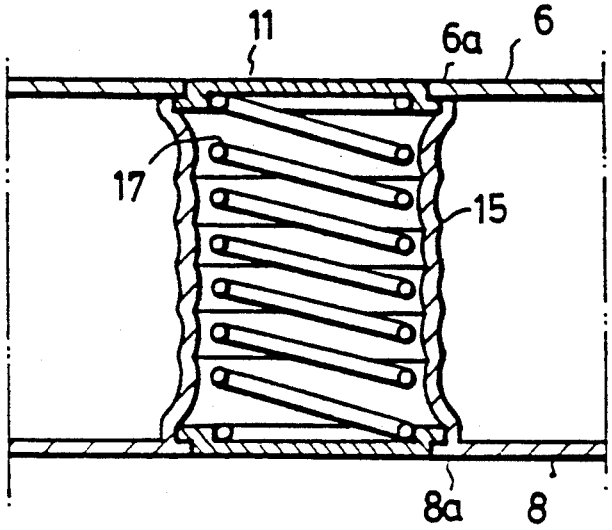
Figure 6B:
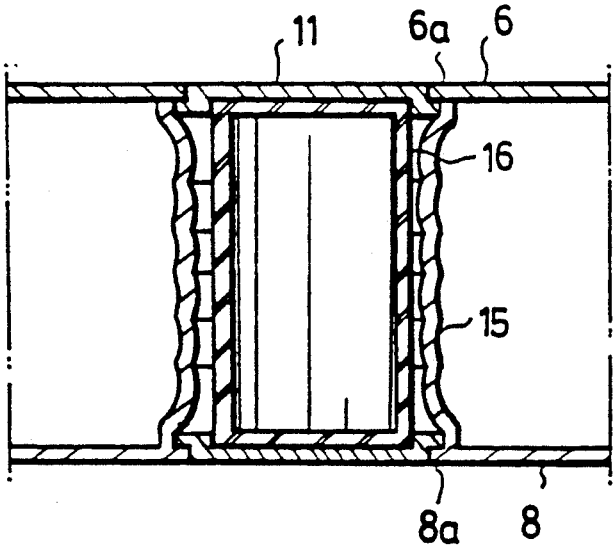

FIGS. 6*a* and 6*b* show second and third alternate embodiments of an air bag 3 each having bellows means comprising the effective number of cylindrical bellows 15 in accordance with the present invention. In the second alternate embodiment of FIG. 6*a*, a compression coil spring 17 is received in each cylindrical bellows 15 while, in the third alternate embodiment of FIG. 6*b*, an elastic rubber 16 is received in each cylindrical bellows 15.

The operational effect of the midsole 1 of the present invention will be described hereinafter.

The operational effect of the present midsole 1 is classified into three types in accordance with the opening state of the air control valve 4, that is, a fully closed state, a partially opened state and a fully opened state. In the aforementioned three states, the operational effects are different from the others.

If described in detail, in the case of the fully closed state of the air control valve 4, it is required to determine, prior to the closing operation of the valve 4, the expansibility of the air bag 3 by controlling the outer pressure applied to the air bag 3. In this state, it was noted that the present midsole 1 provides the optimum cushioning and elastic restoring or resilience effect for the shoe owing to an improved interaction between the air in the closed air bag 3, the bellows protrusions 7*a* and 7*b* and the springs 10 and, in this respect, this fully closed state can be efficiently selected in the case of a general exercise such as running.

In the case of the partially opened state of the air control valve 4, a part of the air in the air bag 3 is discharged from the air bag 3 when the air bag 3 is applied with an outer pressure. In this regard, this partially opened state can be efficiently selected when a relatively large pressure is necessarily applied to the air bag 3 such as when the wearer jumps from a higher place.

On the other hand, in the case of the fully opened state of the air control valve 4, the air in the air bag 3 is easily discharged from the bag 3 even in the case of relatively small pressure. Thus, the present midsole 1 in this state provides most of the cushioning and elastic restoring effect for the shoe owing to an interaction between the bellows protrusions 7*a* and 7*b* and the springs 10 and, in this respect, this fully opened state can be efficiently selected in the case of walking which generates relatively small pressure.

In accordance with the present invention, the cushioning of the midsole 1 is freely controlled in order to correspond to the using object of the shoe. That is, the air control valve 4 is operated so as to control the discharge of the air from the air bag 3 and this controls the cushioning of the present midsole 1. In result, the present midsole 1 reliably provides the comfort of the wearer regardless of using state of the shoe.

In addition, the resilience of the present midsole 1 can be improved in comparison with the prior embodiments. That is, the present midsole 1 is provided with the bellows protrusions 7*a* and 7*b* and the coil springs 10 and, in this respect, the resilience of the midsole is improved by virtue of the interaction between the air in the air bag 3, the bellows protrusions 7*a* and 7*b* and the springs 10.

Particularly, when the midsole 1 is provided with the frusto-conical bellows protrusions 7*a* and 7*b* as the bellows means and the center balls 9 interposed between the opposite bellows protrusions 7*a* as described in the first alternate embodiment of this invention, it is possible to efficiently prevent the shoe and/or the midsole 1 from being warped by the irregular pressure which is often applied to the shoe.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A midsole having a shock absorber comprising:

a hexahedral-shaped air bag for absorbing an outer shock, said air bag comprising upper and lower parts which are provided with a plurality of vertical bellows members;

a plurality of elastic bodies for providing elasticity for said air bag, each said elastic body being received in each bellow member;

a plurality of upper and lower caps for causing said elastic bodies to maintain their positions in the bellows members, each said cap being mounted on the air bag as engaging with an open end of each bellows member;

an air control valve for controlling air charge in or air discharge from the air bag; and an air communication pipe for permitting the air bag to communicate with said air control valve, said air communication pipe being connected at an end thereof to the air bag and at the other end to the air control valve.

2. A midsole according to claim 1, wherein each said bellows member comprises a cylindrical bellows which extends from said upper part to said lower part of the air bag and receives an integral type of elastic body supported at its upper and lower ends by said upper and lower caps.

3. A midsole according to claim 2, wherein said integral type of elastic body is a spring.

4. A midsole according to claim 2, wherein said integral type of elastic body is an elastic rubber.

5. A midsole according to claim 1, wherein said bellows members comprise frusto-conical bellows protrusions which are provided at the upper and lower parts so as to be opposite to each other, welded to each other with a center ball interposed between each two opposite frusto-conical bellows protrusions and each receives an elastic body which is supported by the upper or lower cap.

6. A midsole according to claim 5, wherein said elastic body is a spring.

7. A midsole according to claim 5, wherein said elastic body is an elastic rubber.

8. A midsole according to claim 2 wherein both said bellows members and said elastic bodies received in the bellows members are regularly arranged on said upper and lower parts of the air bag.

9. A midsole according to claim 8, wherein both said bellows members and said elastic bodies are arranged along the peripheries of said upper and lower parts of the air bag except for a part at which said air communication pipe is connected to the air bag.

* * * * *